US005159872A

United States Patent [19]

Dettmers et al.

[11] Patent Number: 5,159,872

[45] Date of Patent: Nov. 3, 1992

[54] VALVE UNITS FOR USE IN HYDRAULIC CONTROL SYSTEMS OF MINING EQUIPMENT

[75] Inventors: Michael Dettmers, Kamen; Bernd Peters, Dülmen, both of Fed. Rep. of Germany

[73] Assignee: Gewerkschaft Eisenhutte Westfalia GmbH, Fed. Rep. of Germany

[21] Appl. No.: 682,986

[22] Filed: Apr. 10, 1991

[30] Foreign Application Priority Data

Apr. 19, 1990 [DE] Fed. Rep. of Germany ..... 4012481

[51] Int. Cl.[5] ..... F15B 11/08; F15B 13/04

[52] U.S. Cl. ..... 91/432; 91/449; 91/469; 137/901

[58] Field of Search ..... 91/432, 449, 450, 452, 91/468, 469, 461; 137/596.2, 901, 860; 251/83

[56] References Cited

U.S. PATENT DOCUMENTS

| | | | |
|---|---|---|---|
| 3,948,147 | 4/1976 | Sauer et al. | 91/468 |
| 4,088,151 | 5/1978 | Schurger | 137/596.2 |
| 4,214,607 | 7/1980 | Bouteille | 137/860 |
| 4,461,449 | 7/1984 | Turner | 137/596.2 |
| 4,549,565 | 10/1985 | Short | 137/860 |
| 4,694,862 | 9/1987 | Rott | 137/901 |
| 4,941,504 | 7/1990 | Beauvir | 251/83 |

FOREIGN PATENT DOCUMENTS

| | | | |
|---|---|---|---|
| 948938 | 2/1964 | United Kingdom | 137/596.2 |
| 2216238 | 10/1989 | United Kingdom . | |

*Primary Examiner*—Edward K. Look
*Assistant Examiner*—Hoang Nguyen
*Attorney, Agent, or Firm*—Samuels, Gauthier & Stevens

[57] ABSTRACT

A valve block in a mine hydraulic system contains a non-return valve which is opened when a hydraulic control signal occurs to connect a pressure fluid feed or return line to a working chamber of an appliance such as a prop. A auxiliary valve is mounted in the block and is operated manually to relieve the working chamber even if the non-return valve remains closed.

14 Claims, 2 Drawing Sheets

VALVE UNITS FOR USE IN HYDRAULIC CONTROL SYSTEMS OF MINING EQUIPMENT

FIELD OF THE INVENTION

The present invention relates in general to hydraulic systems for operating appliances in underground mine workings and more particularly to a valve unit for use in such systems.

BACKGROUND OF THE INVENTION

In hydraulic working support systems, such as are used in underground mining, non-return check valves are associated with the hydraulic props and the additional hydraulic appliances, such as for example the shifting rams and walking mechanisms, the alignment devices and roof bar adjusting devices, in order to isolate the pressure chambers of the hydraulic appliances. Known non-return valves are opened by means of control pistons, which receive hydraulic pressure control signals, in order, for example to retract the props, or otherwise to reduce the pressure in the working chambers or, to supply the working chambers with the hydraulic high pressure fluid, for example for extending and setting the props. Non-return valves of the construction which is known from GB 2216 238 (which corresponds to U.S. Pat. No. application 312 075 filed Feb. 16, 1989 and assigned to the same assignee as this application) have proved successful for the above mentioned purposes. As the closure member, these known non-return valves each use a valve sleeve guided on a rod. The valve sleeve is subjected to pressure-equalization by means of a compensating piston on the rod and is held on a valve seat substantially solely by the force of a relatively weak auxiliary spring. In the closing state of the valve, a main valve spring keeps the rod in abutment with a housing shoulder. Due to this the operational reliability of the valve is increased and at the time of the closing operation, the closure member is prevented from striking too hard against the valve seat, which may lead to damage and to failure of the valve.

One drawback of the non-return valves, which are opened hydraulically and are known in various constructions, consists above all in the case of failure of the hydraulic control, for example in the case of breakdown of the pump pressure instanced by the fracture of a cable or in the case of fracture of a valve component. In these circumstances, the non-return valve can no longer be opened and accordingly the pressure in the pressure chamber shut-off by the latter cannot be relieved without dismantling the valve and corresponding danger due to external intervention. Especially if the hydraulic appliances are the props of a support, this may lead to considerable disturbances in the operating sequence and also to considerable danger for the face workers, since the props or other hydraulic appliances are blocked and unable to extend or retract. Although it is well known to use additional pressure relief valves to protect the equipment these valves open automatically when a predetermined excess pressure above normal pressure is exceeded and do not assist in the problem identified above.

It is an object of the invention to provide apparatus which will combat the aforementioned difficulties and problems, without excessive expenditure.

SUMMARY OF THE INVENTION

The present invention seeks to provide a valve unit or apparatus designed so that even in the case of failure of the hydraulic control of a non-return valve, the associated hydraulic appliance can still be supplied hydraulically in a reliable manner with pressure medium or relieved thereof, at least in the case of emergency operation. In accordance with the invention a relief valve in the form of an auxiliary valve able to be actuated by hand, is connected to the pressure side of the non-return valve, which is connected to the working chamber of the hydraulic appliance. The auxiliary relief valve is thus associated with the actual non-return valve, and the relief valve, in the case of failure of the hydraulic control of the non-return valve, is able to take over its function, i.e. can be used for opening the working chamber shut off by the non-return valve, to the return or to the atmosphere or, also to the pressure feed or supply line. If the valve unit according to the invention is associated with the working chamber of an hydraulic prop, then in the case of failure of the non-return valve, the prop pressure chamber may be relieved of load pressure by actuating the relief valve in order to withdraw the prop or actively retract it hydraulically. The actuation of the relief valve essentially takes place manually. The relief valve may have small dimensions and may have a simple and correspondingly economical construction, since under normal operation it does not need to undertake any valve function; on the contrary generally it is actuated solely as an auxiliary valve when in the case of an exceptional disturbance, the hydraulic opening of the non-return valve is not possible. The increased expenditure for the provision of the relief valve is therefore relatively low. At the same time, the advantage results that as an actual working valve, the non-return valve does not need to experience any changes, so that for the non-return valve, customary valves, which have proved successful in use, of various constructions, can be used. In the case of emergency actuation by means of the relief valve, the hydraulic medium may be vented into the open or, drained back into the return line of the hydraulic system.

In a preferred form the present invention provides a valve unit comprising a non-return valve with an inlet connectible to a pressure fluid feed or return line, an outlet connectible to a working chamber of an hydraulic appliance, hydraulic means for opening the non-return valve to establish connection between the inlet and outlet an auxiliary relief valve connectible to the outlet of the non-return valve and manual means for operating the auxiliary valve to relieve the pressure in the working chamber even when the non-return valve is closed. The hydraulic opening means may be a control piston connected to an hydraulic line or conduit which conveys a pressure fluid to the piston to open the valve. Where the valve unit or apparatus is used with an appliance such as a prop for example the outlet from the non-return valve can lead to a main working chamber charged to extend the prop while the line conveying the pressure fluid to the control piston can be connected to a complementary annular chamber charged to retract the prop. A further pressure relief valve which opens automatically at some excess pressure can be connected to the outlet of the non return valve to protect the prop as is known.

Preferably, the aforementioned auxiliary relief valve consists of a tappet-actuated non-return valve. The relief valve is appropriately constructed so that it is easily opened mechanically. This may take place in a simple manner by means of a screw-threaded component or other mechanical actuating member. The screw-threaded component can be appropriately constructed as a tappet screw, by means of which the relief valve constructed as a non-return valve is opened by tappet actuation.

It is advantageous for the main non-return valve, which is opened hydraulically, and the auxiliary relief valve which is actuated manually, to be combined in a parallelepipedal shaped common block or the like, which in this case is provided with mounting bores for the two aforementioned valves and with connecting passages or bores, which form the hydraulic connections and internal passages.

The housing of the auxiliary relief valve can be located in a stepped bore of the block and is secured in this receiving bore by means of a U-shaped insertion clamp or fork. This results in a particularly simple construction of the relief valve and its fastening on the block.

In detail, the arrangement is advantageously such that on the housing of the auxiliary valve there are at least one bore, or preferably a plurality of radial drainage bores, extending transversely to its axis, so that on the periphery of the housing the latter open out in or adjacent to an outer end region of the receiving bore of the block. On opening of the relief valve, the pressure medium may squirt out through the bore openings. It is recommended to cover the drainage bores at their openings or mouths by means of a resilient protective sealing ring, in order to prevent the penetration of dirt into these bores. Furthermore, it is recommended to dispose the drainage bores on the housing of the relief valve so that they open into a groove-like recess of the housing covered over by a collar external to the block. Thus, the drainage bores are covered on the outside, so that the high pressure liquid escaping at the time of actuation of the valve, passes out without danger.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
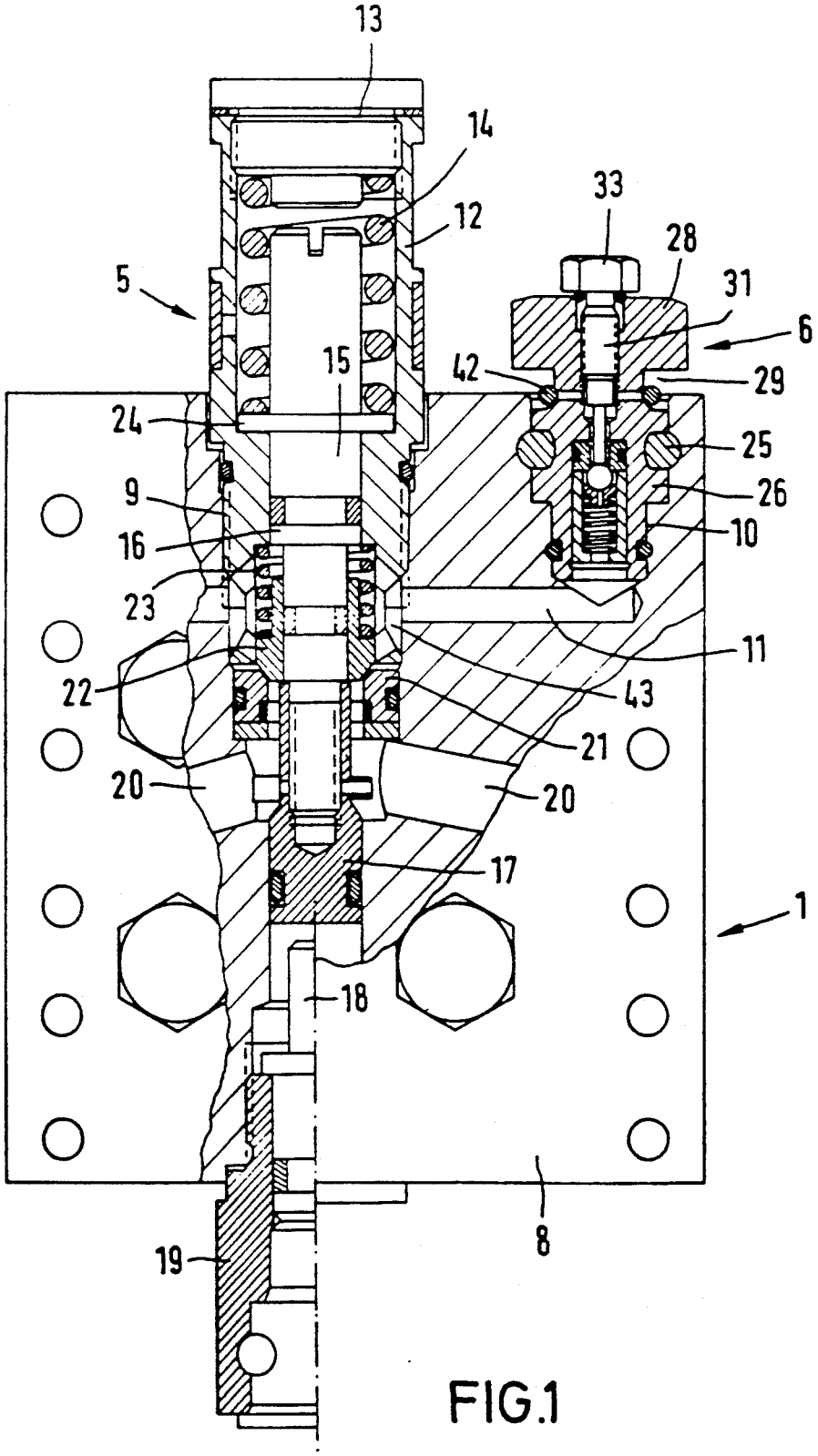
FIG. 1 is a part cut-away and sectional side view of a valve unit constructed in accordance with the invention.
Figure 2:
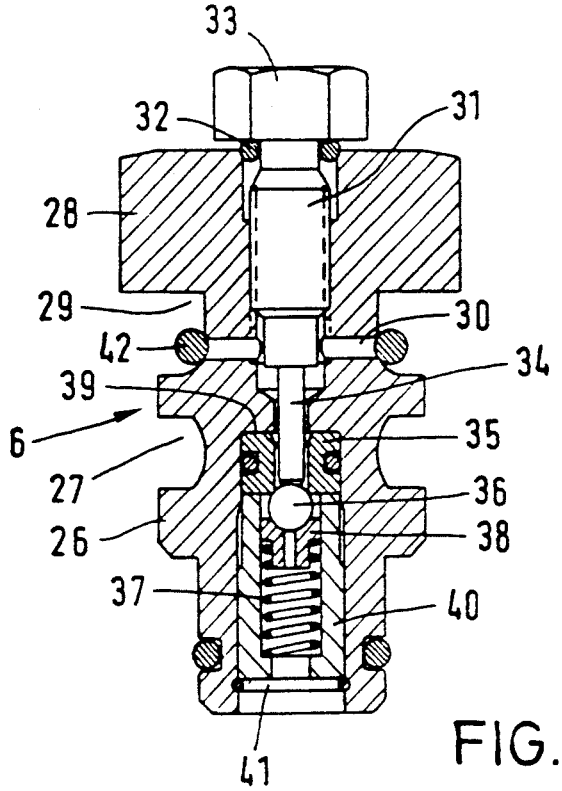
FIG. 2 is a longitudinal section through a pressure-relief valve assembly usable in the unit shown in FIG. 1.
Figure 3:
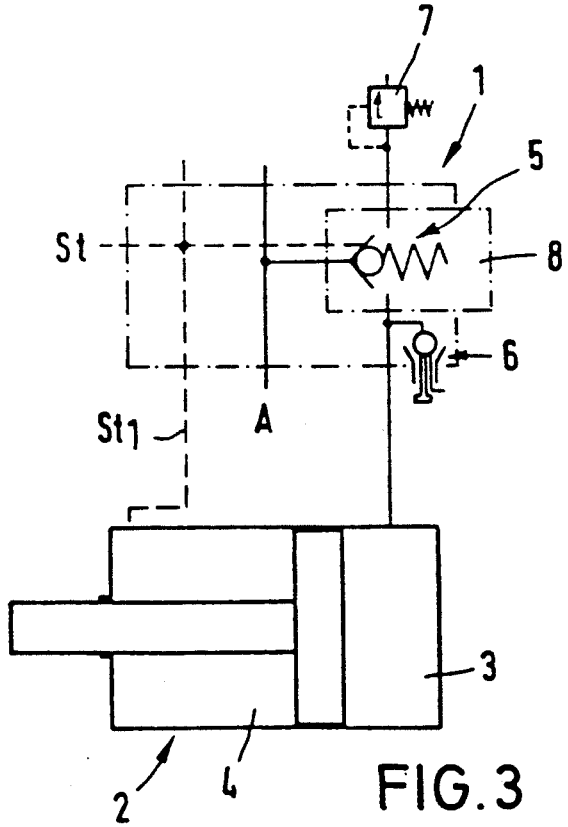
FIG. 3 is a schematic representation of the valve unit used with an hydraulic appliance.

A compact valve unit 1 constructed in accordance with the invention and shown in FIGS. 1 and 2 can be used with some hydraulic appliance and FIG. 3 depicts the valves of the unit 1 in conjunction with an appliance in the form of a piston and cylinder 2. As shown in FIG. 3, the piston and cylinder 2, which can be a prop of mine roof support, has a main working chamber 3 and an annular auxiliary chamber 4. Both chambers 3, 4 are alternately charged with pressure fluid and relieved to cause the piston to be displaced. In the valve unit 1 associated with the appliance 2 there is a one-way non-return valve 5 which is opened hydraulically and a non-return relief valve 6 which is actuated manually and a further relief valve 7. The valve 5 is connected on its inlet side to a line A and on its outlet side to a line B leading to the chamber 3. A hydraulic control line leads to a control input of the valve and when a pressure signal is present in the line St the valve 5 opens. A branch line Sti leads from the line St to the chamber 4. The line A is optionally and selectively connected to a pressure supply line or to a return line of a hydraulic system e.g. by means of a control valve (not shown) or the like. The pressure relief valve 7 which opens automatically at a pre-determined level of excess pressure is connected to the outlet side of the valve 5 and hence to the chamber 3. The other relief valve 6 is also connected to the outlet of the valve 5. As can be appreciated the chamber 3 can be supplied with pressure fluid by way of the line A when the valve 5 is opened by the pressure signal in line St. Where the appliance is a prop the valve 5 thus acts as a setting or check valve. The control line St can be exposed to the same pressure as the supply line but when the line A is subjected to pressure the large working area of the piston in the chamber 3 ensures the prop extends. To retract the prop the line A is connected to the return line and the valve 5 is opened again by the pressure signal in the line St so that this pressure acts in the chamber 4. In this mode the pressure fluid in the working chamber 3 is able to pass by way of the line B, the opened valve 5 and the line A into the return line.

As is known, excess pressure in the chamber 3 is automatically relieved by the valve 7. Should a fault occur so that the valve 5 cannot be opened the chamber 3 can be relieved manually by operating the valve 6.

Turning now to FIGS. 1 and 2, it can be seen that the valves 5 and 6 are mounted into bores 9, 10 in a generally parallelepipedal shaped block 8. The block 8 has various internal passages and external ports serving as hydraulic fluid flow paths. A passage 11 forms the line B of FIG. 3, ie the outlet side of the valve 5 and passages 20 correspond to the line A, ie the inlet side of the valve 5. The valve 5 is embodied as an assembly or cartridge screwed into the bore 9. The valve 5 may be constructed in accordance with U.S. Pat. application No. 312075 assigned to the same assignee as this application the content of which is herein incorporated by reference. As shown in FIG. 1, the valve 5 has a housing 12 containing a main spring 14 bearing on a closure piece 13 and on a rod 15 provided with a piston 16, guided in an axial bore of the housing 12. A piston 17 in an extension of the bore 9 of the block 8 confronts a tappet piston 18 which is guided by a connector 19 screwed into the bore 9. The connector 19 forms the connection for the line St. Between the passages 11, 20 there is a valve seat 21 supported on a shoulder in the block 8 against which a valve closure member 22 in the form of a sleeve is urged by a spring 23. The sleeve 22 is displaceably guided on the rod 15. The force of the spring 23 is considerably less than the spring 14 and in the closed state of the valve 5, the spring 14 holds a collar 24 of the rod 15 in abutment with an annular shoulder of the housing 12.

If the line St is subjected to pressure the tappet 18 moves up against the piston 17 to displace the rod 15 and the closure member 22 against the spring force so that the member 22 lifts clear of the seat 21 to establish connection between the passages 20, 11. If the pressure in the line St decreases the valve 5 closes again under the action of the spring 14 and the weaker auxiliary spring 23 serves to prevent the closure member 22 from engaging with the seat 21 with hard impact force.

The separate relief valve 6 is disposed parallel to the valve 5 and has a construction which can be best seen in FIG. 2. The valve 6 is again of cartridge like form with a housing 26 fitted into the bore 10 and fixed therein with a U-shaped fork 25 (FIG. 1) in a manner known per se. A peripheral groove 27 (FIG. 2) in the housing 26 receives the fork 25. Between the groove 27 and a top collar 28 the housing 26 has a recess or groove 29 into which radial bores 30 open. The bores 30 communicate with a central stepped axial boring of the housing 26. The valve 6 is a tappet actuated valve with a screw threaded operating member 31 engaged in the inner boring of the housing 26 and sealed with a gasket 32. The operating member 31 has a polygonal head 33 above the collar 28 of the housing 26 which can be engaged with a spanner or the like. The central boring in the housing 26 also contains a valve tappet 34 and a valve seat 35 with a sealing gasket supported on a shoulder 39 in the housing 26. A valve closure member in the form of a ball 36 engages on the seating 35 under the action of a valve spring 37. The spring 37 biases the ball 36 against the seating 35 via a guide 38 to close the valve 6. The seating 35 is fixed in place with a sleeve 40 inserted into the central boring of the housing 26 and retained with a securing means such as a snap ring or circlip. The sleeve 40 receives the ball 36, the spring 37 and the guide 38. The recess 29 beneath the collar 28 contains a resilient sealing ring 42 which serves to close off the bores 30 from extraneous dirt. FIG. 1 shows how the bores 30 open to the periphery of the housing 26 so that when the valve 6 is inserted into the bore 10 the openings of the bores 30 and the ring 42 lie at the outer end of the bore 10 which can be enlarged. The openings of the bores 30 and the ring 42 are covered over and protected by the stout collar 28 into which the operating member 28 is screwed. In order to open the valve 6, e.g. in an emergency to relieve the prop pressure, the member 38 is turned by hand into the housing 26 to force the tappet 34 to raise the ball 36 from the seat 35.

When the valve 5 is closed the pressure fluid in the working chamber 3 of the appliance can escape via a chamber 43 of the valve 5 and the passage 11 and the axial boring in the housing 26 and thence via the bores 30 to the surroundings. When this occurs the ring 42 is lifted clear of the openings of the bores 30 by the pressure of the relieved fluid. Since the valve 6 is in general only operated in exceptional circumstances it is quite acceptable to allow the pressure fluid which is relieved to vent to the surroundings but it is feasible to allow the fluid to pass back to the return line.

We claim:

1. In or for an hydraulic system for a mine working comprising an hydraulic appliance with a working chamber and pressure fluid feed and return lines connectible to the chamber; a valve unit comprising a non-return valve with an inlet connectible to the pressure fluid feed or return lines, an outlet connectible to the working chamber, hydraulic means for opening the non-return valve to establish connection between the inlet and the outlet, an auxiliary relief valve connectible to the outlet of the non-return valve and manual means for operating the auxiliary valve to relieve the pressure in the working chamber even when the non-return valve is closed;

wherein the non-return valve and the auxiliary relief valve have housings which are detachably mounted into bores in a common block; and the housing of the relief valve has a plurality of drainage bores which open from a region of the housing leading to the outside of the block to allow the escape of relieved pressure fluid.

2. A valve unit according to claim 1, wherein the manual means for operating the auxiliary valve is a turnable screw-threaded operating member.

3. A valve unit according to claim 1, wherein the manual means for operating the auxiliary valve at least includes a tappet.

4. A valve unit according to claim 1, wherein the auxiliary relief valve has a cartridge-like housing retained with a clamping piece in the associated bore in the block.

5. A valve unit according to claim 1 wherein the openings of the drainage bores are covered over by a resilient sealing ring to prevent the ingress of dirt.

6. A valve unit according to claim 1, wherein the openings of the drainage bores lie in a recess beneath a protective collar of the housing.

7. A valve unit according to claim 1 wherein the bores in the block for receiving the valves are parallel to one another.

8. A valve unit according to claim 1, wherein there are passages in the block for passing pressure fluid and the auxiliary valve is connected via one such passage to a chamber in the non-return valve which leads to the outlet.

9. A valve unit according to claim 1, wherein the housing of the non-return valve confronts a tappet piston serving as the hydraulic opening means, the tappet piston being associated with a connector on the block which leads to a hydraulic control line.

10. A valve unit according to claim 9 wherein the housing of the non-return valve contains a sleeve serving as a valve closure member, the sleeve being guided on a rod provided with a pressure-compensating piston and there are further provided a main spring which acts on the rod to urge the latter onto a shoulder in the housing in the closed state and an auxiliary spring serving to hold the sleeve in a closed state.

11. A valve unit according to claim 1 wherein the hydraulic opening means is a control piston connected to an hydraulic line which conveys pressure fluid to the piston to open the valve, the outlet of the non-return valve is connected to a main working chamber of the hydraulic appliance and the hydraulic line which conveys pressure fluid to the piston is connected to an auxiliary working chamber of the appliance.

12. In or for an hydraulic system for a mine working comprising an hydraulic appliance with a working chamber and pressure fluid feed and return lines connectible to the chamber; a valve unit comprising a non-return valve with an inlet connectible to the pressure fluid feed or return lines, an outlet connectible to the working chamber, hydraulic means for opening the non-return valve to establish connection between the inlet and the outlet, an auxiliary relief valve connectible to the outlet of the non-return valve and manual means for operating the auxiliary valve to relieve the pressure in the working chamber even when the non-return valve is closed, wherein the non-return valve and the auxiliary relief valve have housings which are detachably mounted into bores in a common block, wherein the housing of the auxiliary valve has a continuous central axial stepped bore containing a valve seat, a valve closure member, a spring for urging the closure member against the seat and a tappet forming part of the manual means, and wherein the stepped bore also contains a sleeve which secures the seat in the bore and the closure member and the spring are located in the sleeve.

13. A valve unit according to claim 12, wherein the auxiliary relief valve has a cartridge-like housing retained with a clamping piece in the associated bore in the block.

14. A valve unit according to claim 12, wherein the sleeve is fixed in place by means of a detachable securing member.

* * * * *